United States Patent [19]

Meyer et al.

[11] 4,131,775

[45] Dec. 26, 1978

[54] COMPRESSED-GAS CIRCUIT-INTERRUPTERS OF THE PUFFER-TYPE HAVING IMPROVED SUPPORTING, SHIELDING AND ASSEMBLY FEATURES

[75] Inventors: Jeffry R. Meyer, Penn Hills; Robert L. Hess, North Versailles, both of Pa.

[73] Assignee: Westinghouse Electric Corp., Pittsburgh, Pa.

[21] Appl. No.: 738,803

[22] Filed: Nov. 4, 1976

[51] Int. Cl.[2] ..... H01H 33/02; H01H 33/24; H01H 33/88

[52] U.S. Cl. ..... 200/148 R; 200/148 A

[58] Field of Search ..... 200/148 A, 148 R

[56] References Cited

U.S. PATENT DOCUMENTS 3,214,550 10/1965 Easley ..... 200/148 A

*Primary Examiner*—Robert S. Macon
*Attorney, Agent, or Firm*—W. A. Elchik

[57] ABSTRACT

An improved compressed-gas puffer-type circuit-interrupter is provided having improved supporting, shielding and assembly features for making ready provision for a separate bench subassembly of the gas-interrupter module, and enabling its ready application to a grounded metallic tank-type of circuit-interrupter, or, alternatively, to gas-insulated transmission-line equipment, as desired.

Improved supporting features involve the utilization of a pair of upstanding side-insulating supporting shields, which substantially solely support the upper relatively-stationary contact and shielding assembly, apart from any support needed by the upper terminal-bushing, when used. Additionally, the invention comprises improved rod guiding features for the movable operating cylinder, improved shielding structure on both the stationary and movable contact structures and improved capacitor-tube mounting-assembly arrangements, an improved lower metallic base-support, having a shielding portion, which shields the relatively-sharp-cornered hardware features, such as the movable-contact guiding stem, reducing the electrical gradient, employing tubular shielding structures adjacent the central heavy supporting plate for relieving the electrostatic field, and employing, additionally, an improved upper electrostatic shielding arrangement, easily attached and disassembled by a simplified spring-clip assembly.

An additional feature of the invention is the use of a spherical bearing located at the upper end of the insulating pull-rod assembly, or operating-rod assembly to compensate for inaccuracies in manufacture, and improving the general assembly features adapting the modules for bench-assembly inspection.

22 Claims, 31 Drawing Figures

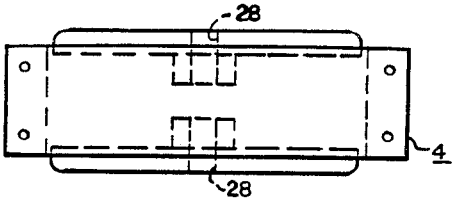
FIG. 7.
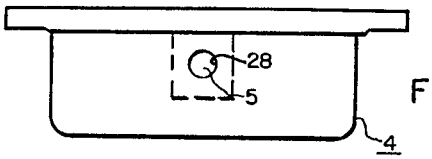
FIG. 6.
FIG. 8.
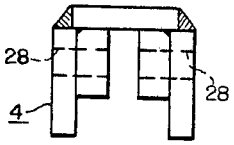
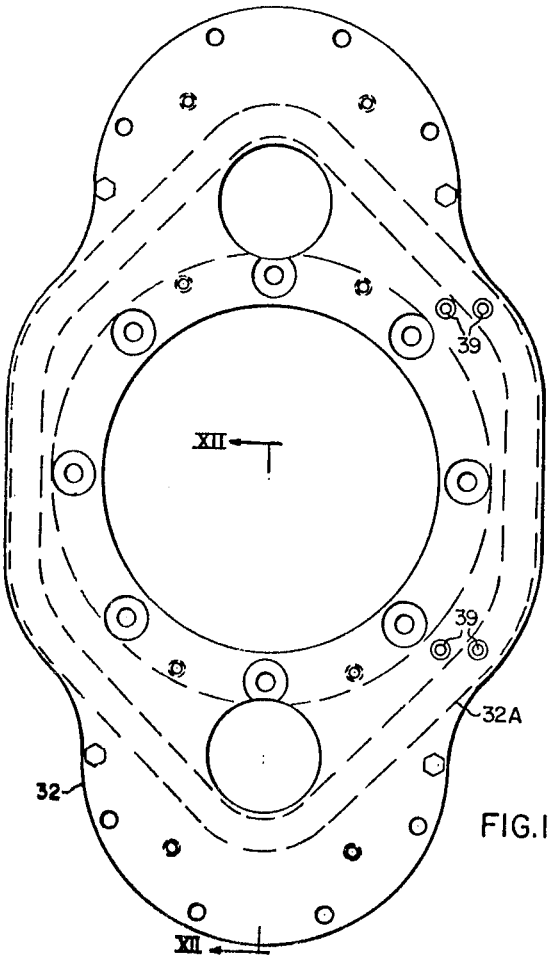
FIG. 11.
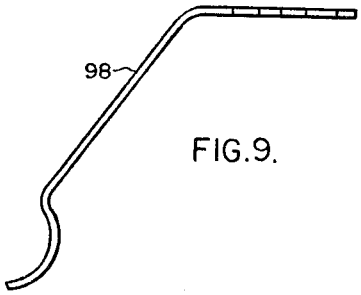
FIG. 9.
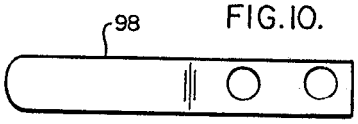
FIG. 10.
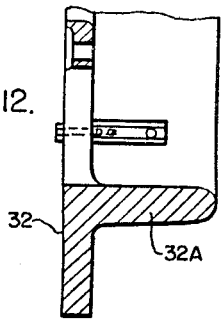
FIG. 12.

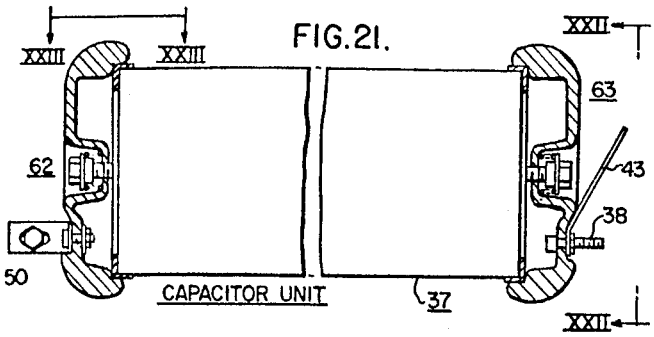
FIG.21.
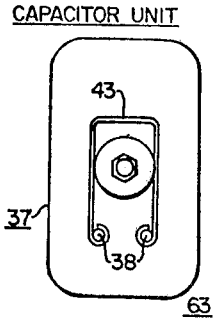
FIG.22.
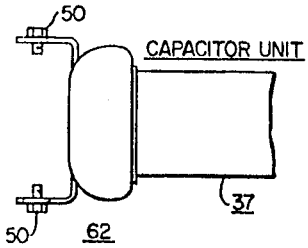
FIG.23.
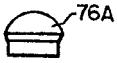
FIG.25.
FIG.26.
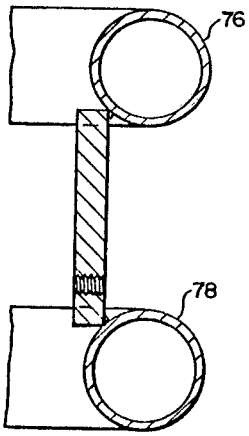
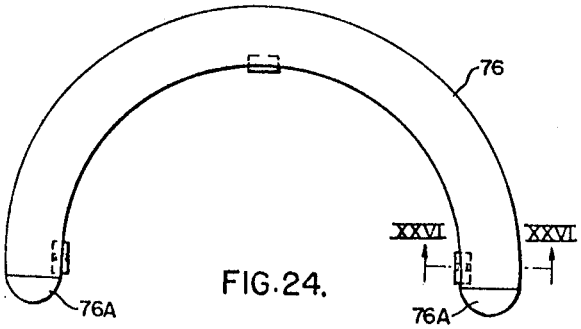
FIG.24.
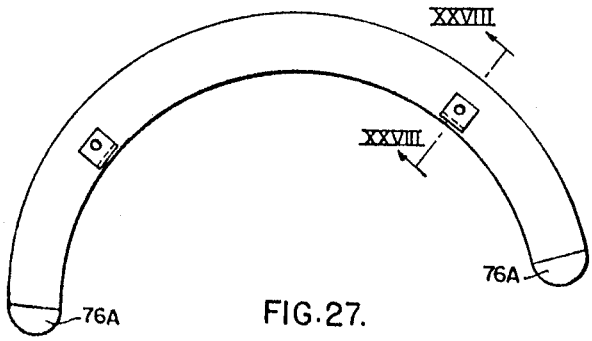
FIG.27.
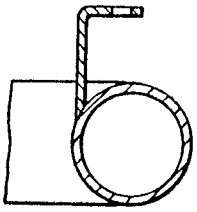
FIG.28.

COMPRESSED-GAS CIRCUIT-INTERRUPTERS OF THE PUFFER-TYPE HAVING IMPROVED SUPPORTING, SHIELDING AND ASSEMBLY FEATURES

CROSS-REFERENCE TO RELATED APPLICATIONS

Reference may be made to U.S. Pat. application Ser. No. 645,753, filed Dec. 31, 1975 (W.E. Case 46,258) by T. E. Alverson et al, entitled "Circuit Breaker", and U.S. Pat. application Ser. No. 645,867, filed Dec. 31, 1975 (W.E. Case 46,257) by Russell N. Yeckley et al, entitled "Circuit Breaker", and U.S. Pat. application Ser. No. 645,867 filed 12-31-75, (W.E. Case 46,399) by Charles F. Cromer et al, entitled "High-Performance Double-Flow Puffer-Type Circuit-Interrupter", U.S. Pat. applications Ser. No. 560,461, filed Mar. 21, 1975 (W.E. Case 45,454) by Joseph R. Rostron, entitled "Double-Puffer-Type Compressed-Gas Circuit-Interrupter Constructions", U.S. Pat. applications Ser. No. 576,820, filed May 12, 1975 (W.E. Case 45,674) by Jospeh R. Rostron, U.S. Pat. application Ser. No. 602,705, filed Aug. 7, 1975, by Cromer et al; U.S. Pat. application Ser. No. 616,703, filed Sept. 25, 1975, by Rostron et al (W.E. Case 46,072); U.S. Patent Application (W.E. Case 46,250); U.S. Patent Application (W.E. Case 46,251) Cromer et al; also, U.S. Pat. application (W.E. 46,715) Ser. No. 685,826, filed May 13, 1976, Freeman et al; U.S. Pat. application (W.E. 46,714), Ser. No. 685,466, filed May 12, 1976, Meyer et al; and U.S. Pat. application (W.E. 46,713) Ser. No. 685,465, filed May 12, 1976, all of said patent applications being assigned to the assignee of the instant patent application. Reference may also be made to U.S. Pat. application Ser. No. 645,752, filed Dec. 31, 1975 by Cromer et al, entitled "Improved Double-Flow Puffer-Type Single-Pressure Compressed-Gas Circuit-Interrupter".

SUMMARY OF THE INVENTION

In accordance with the present invention, there is provided an improved compressed-gas, puffer-type circuit-interrupter involving improved assembly and shielding features, adapting the same for bench-assembly prior to a subsequent installation into either a metallic grounded tank-type circuit-interrupter, generally similar to the wellknown oil circuit-breaker structures, or, alternatively, adapting such a bench-assembled, modular structure to gas-insulated transmission-line equipment, when desired.

Novel features of the instant invention include the utilization of a spherical bearing for enabling ready free operation of the operating rod, and thereby compensating for any inaccuracies of manufacture, which may occur. In addition, features of the invention involve the use of a steel rod, for example, for providing correct guidance of the movable operating puffer-cylinder, novel electrostatic shielding, supplied by the lower, central, metallic baseplate, electrostatic tubing, both at the aforesaid base plate, and also at the lower end of the hollow upstanding insulating supporting tube, ready attaching means for readily attaching the capacitor-tubes for the division of equal voltage across both of the two modular interrupting units, and improved and readily-detactable shielding means disposed at the upper end of each of the stationary contact structures.

A very important additional feature of the invention is the utilization of side, generally semi-circular upstanding insulating supporting tubes, which support the upper stationary contact and shielding structure from the lower-disposed central supporting-plate structure, thereby enabling the upper stationary contact structure to either be electrically connected to the interior ends of terminal-bushings with no stress supplied therebetween, or, alternatively, enabling the modular units to be adapted for gas-insulated, transmission-line equipment.

BRIEF DESCRIPTION OF THE DRAWINGS

FIG. 6 is a side-elevational view of the upper conducting shielding cross-bar structure;

FIG. 7 is a top plan view of the cross-bar shielding structure of FIG. 6;

FIG. 8 is an end elevational view of the conducting cross-bar structure of FIGS. 6 and 7;

FIG. 9 is a side elevational view of one of the three resilient spring-clips associated with the stationary contact structure to hold the upper shield assembly 96 in place;

FIG. 10 is a top plan view of the resilient spring-clip structure of FIG. 9;

FIG. 11 is a top plan view of the relatively-heavy metallic support-plate structure for supporting the two puffer interrupting units of the present invention;

FIG. 12 is a fragmentary sectional view taken substantially along the line XII-XII of FIG. 11;

FIG. 21 is a side elevational view, partly in vertical section, of the capacitor-tube illustrating, in vertical section, the end mounting fittings;

FIG. 22 is an end elevational view of the right-hand mounting terminal for the capacitor-tube of FIG. 21, illustrating its resilient U-shaped configuration;

FIG. 23 is a fragmentary top plan view of the left-hand mounting fitting of the capacitor-tube of FIG. 21 showing the association therewith of mounting bolts;

FIG. 24 shows one of the upper shielding tubes associated with the relatively-heavy horizontally-extending metallic casting support-plate;

FIG. 25 is a side elevational view of a tubular end tip for the electrostatic tubular shielding members of FIGS. 24 and 27.

FIG. 26 is a fragmentary enlarged sectional view taken through the line XXVI—XXVI of FIG. 24 of the shielding-tube assembly of FIG. 24, looking in the direction of the arrows;

FIG. 27 is a top plan view of the lower-disposed shielding tube disposed at the lower end of the insulating upstanding supporting cylinder member of FIG. 3;

FIG. 28 is a fragmentary sectional view taken substantially along the line XXVIII—XXVIII of FIG. 27, looking in the direction of the arrows;

DESCRIPTION OF THE PREFERRED EMBODIMENTS

Figure 1:
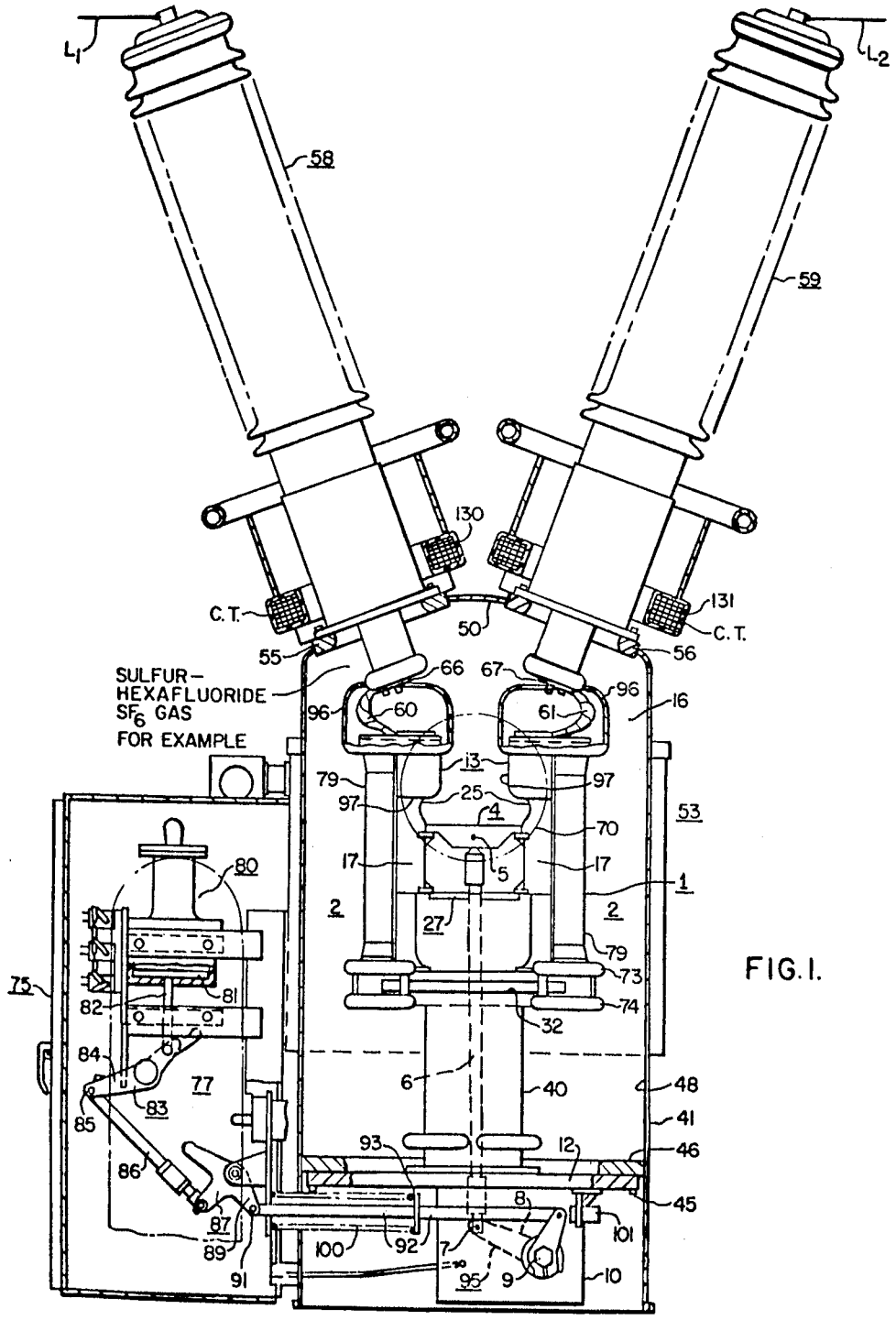
FIG. 1 is a vertical sectional view taken through an improved tank-type compressed-gas circuit-interrupter embodying the principles of the present invention, and the circuit-breaker being shown in the closed-circuit position.
Figure 2:
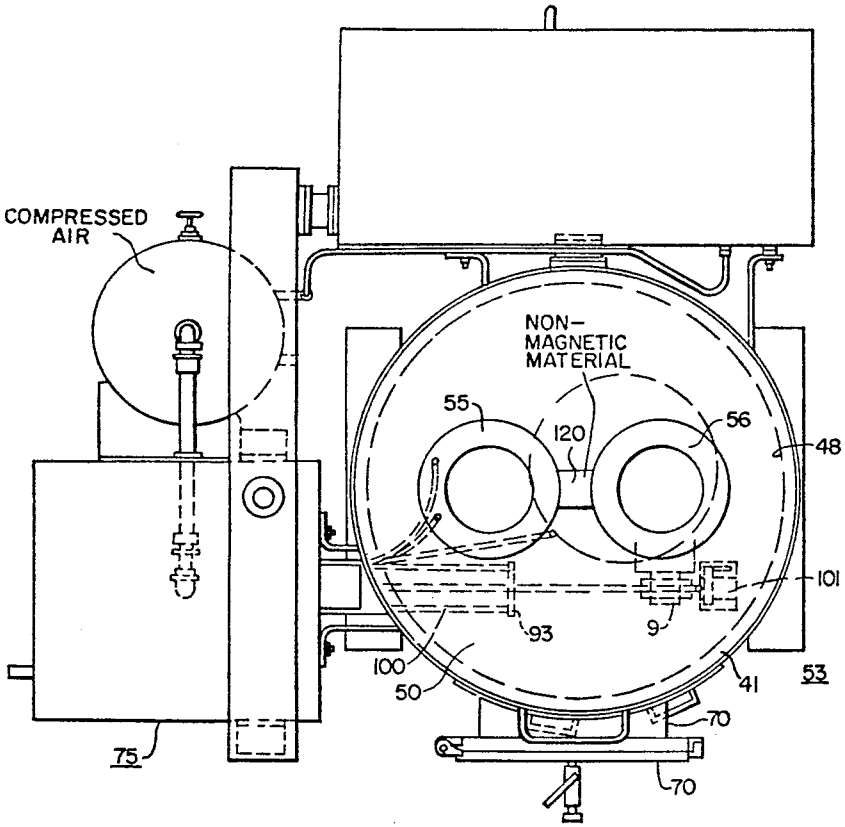
FIG. 2 is a top plan view, considerably-enlarged of the outer metallic grounded tank with the terminal-bushings removed for clarity.
Figure 3:
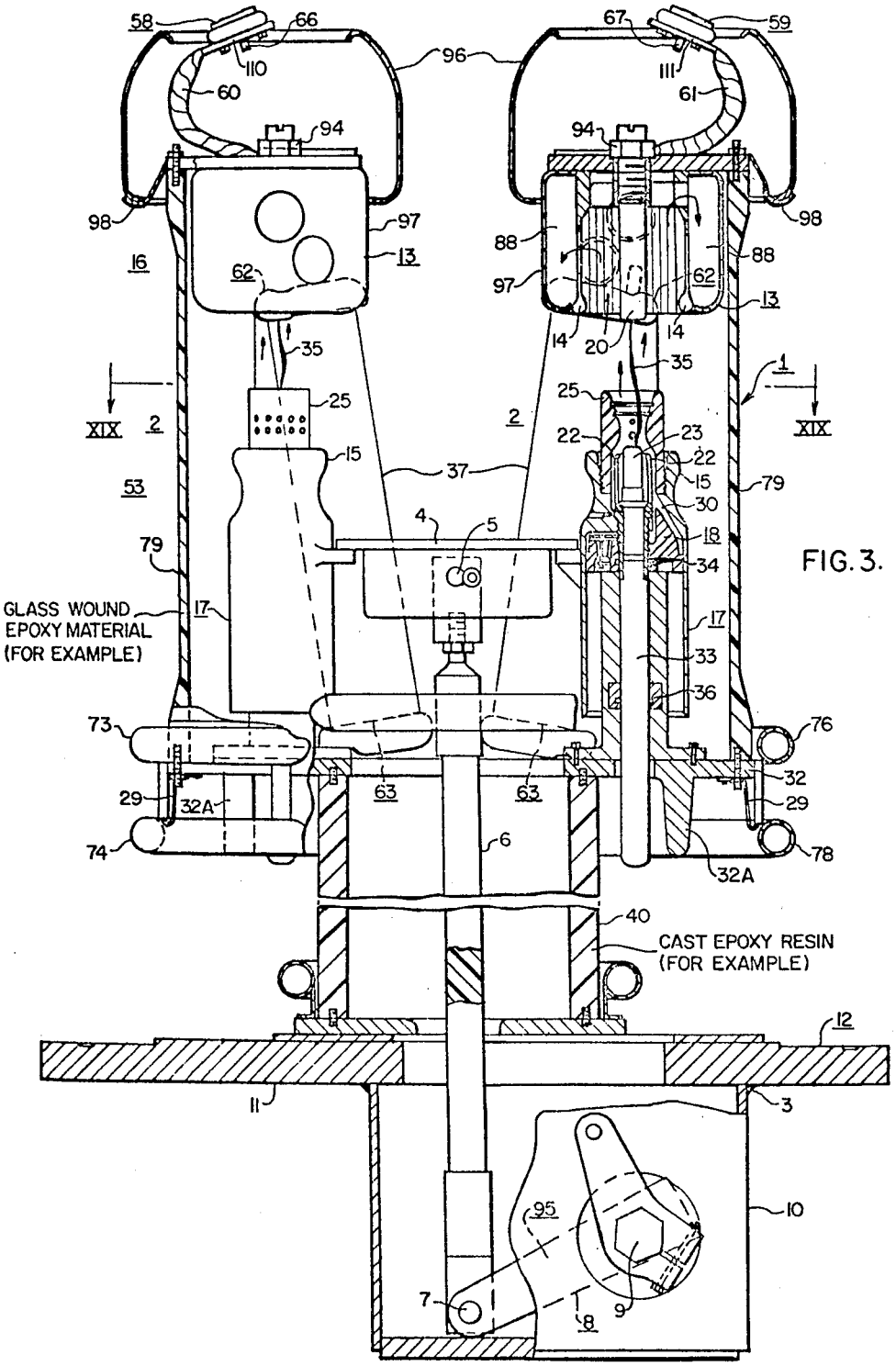
FIG. 3 is an enlarged vertical sectional view taken through the subassembly, involving two modular gas-units together with their connecting operating linkage attached to a relatively-heavy mounting support-plate.

Referring to the drawings, and more particularly to FIGS. 1–3 thereof, it will be observed that FIG. 3 illustrates a subassembly 1 comprising a pair of conjointly-acting gas-modules 2 of the general type set forth in the U.S. Pat. application Ser. No. 645,752, filed Dec. 31, 1975 (W.E. Case 46,252), and assigned to the assignee of the instant patent application. As shown, the two gas modules 2 are electrically and mechanically tied together by a horizontally-extending bridging-bar construction 4 having pivotally connected thereto, as at 5, an upstanding main insulating operating rod 6.

The operating rod 6 is, as shown, pivotally connected at 7 to a bell-crank lever 8, which is affixed to a rotatable main operating shaft 9. A lever box 10 is affixed, as by welding 3 (FIG. 3), for example, to the lower surface 11 of the main metallic support-plate 12.

Each of the gas-modular units 2 comprises an upper relatively-stationary contact structure 13 including a cluster of annularly-arranged main stationary contact fingers 14, which, in the closed-circuit position of the interrupter, as indicated in FIG. 1, make good contacting engagement with an annular movable main contact 15 affixed to an operating-cylinder assembly 17, the latter moving downwardly during the opening operation over a relatively-fixed piston structure 18.

Centrally disposed within the cluster of relatively-stationary main contact fingers 14 is a tubular stationary arcing contact 20, which makes engagement with a plurality of secondary movable arcing contact fingers 22, the movable arcing rod-shaped contact 23 extending therewithin.

Figure 5:
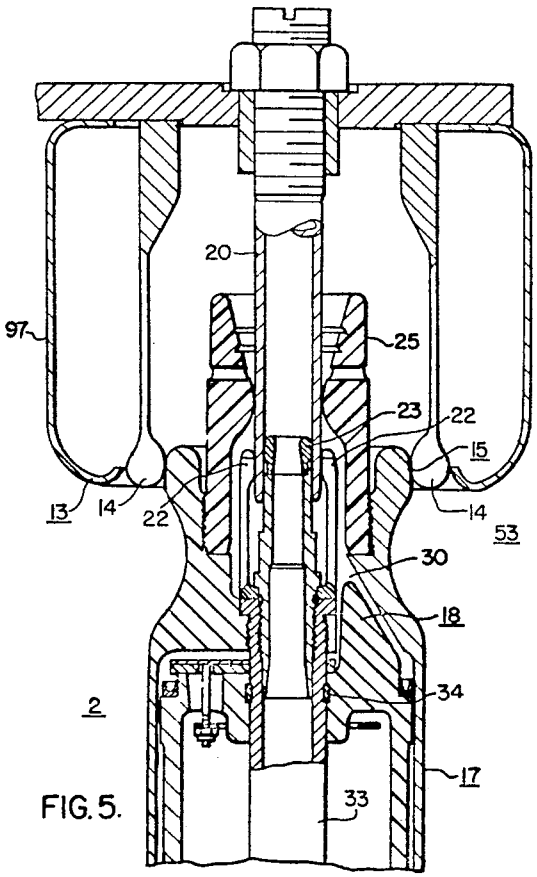
FIG. 5 is a vertical sectional view taken through the stationary and movable contact structures in the closed-circuit position of the interrupter.

Constituting a part of the movable operating-cylinder assembly 17 is an insulating hollow orifice 25, which directs the gas flow emanating from the compression space 30 (FIG. 5), interposed between the stationary piston structure 18 and the outer-disposed movable operating cylinder 17. This gas flow strikes the established arc 35, as indicated in FIG. 3, and effects the rapid extinction thereof.

As will be obvious, the two modular gas-units 2 operate simultaneously by their downward cooperative movement, and, in electrical series, constitute an electrical piece of interrupting equipment having a voltage rating of 242 Kv with an interrupting capacity of 50 to 63,000 amperes, for example. The full-load continuous current rating of the circuit-interrupter, for example, would be 2,000 to 4,000 amperes.

As illustrated in FIG. 3, the two modular units 2 are collectively supported by an upstanding insulating support cylinder 40, which, in turn, is fixedly bolted to the relatively-heavy metallic support-plate 12, referred to hereinbefore.

Following subassembly of the interrupting equipment 1, illustrated in FIG. 3, the grounded metallic tank structure 41 is lifted up and dropped over the subassembly, designated by the reference numeral 1. The heavy metallic support-plate 12 is secured by a plurality of circumferentially-disposed bolts 45 (FIG. 1) to the underside of a heavy mounting ring 46, which, in turn, is welded, for example, to the inner side walls 48 of the outer metallic tank structure 41.

The flexible connectors 60, 61, connected respectively to the upper stationary contact structures 13, may be manually secured to the lower terminal-studs 66, 67 of the two terminal-bushings 58,59 by means of the manhole service opening 70 provided in the side wall of the tank structure 41. Thus, the major portion of the assembly operations may be conducted externally of the tank 41 with plenty of working space. Following the subassembly, as mentioned, the tank 41 is dropped over the subassembly 1 to secure the two assemblies together. It will be noted that attached to the side of the metallic tank is the mechanism housing 75, together with its internally-located pneumatic mechanism 77 (FIG. 1). Generally, this is of the type which, when operated, will effect opening of the circuit-breaker 53. Thus, suitable valve structure 80 will admit high-pressure gas to a piston 81, which will effect downward movement of a pistonrod 82, consequent clockwise rotation of a bell-crank lever 83 having an arm 84, which is pivotally connected, as at 85, by an operating link 86 to a second bell-crank lever 87.

A second arm 89 of the second bell-crank lever 87 has pivotally connected thereto, as at 91, a connecting rod 92 having secured thereto a spring seat 93, which is biased toward the right, as viewed in FIG. 1, in a direction to close the circuit-breaker 53.

The connecting rod 92 is pivotally connected to the bell-crank lever assembly 95, which operates the main operating shaft 9. The construction is such that the compression spring 100 effects closing of the circuit-interrupter 53, a closing shock-absorber 101 (FIG. 1) being provided to limit the closing travel of the circuit-breaker 53.

Figure 31:
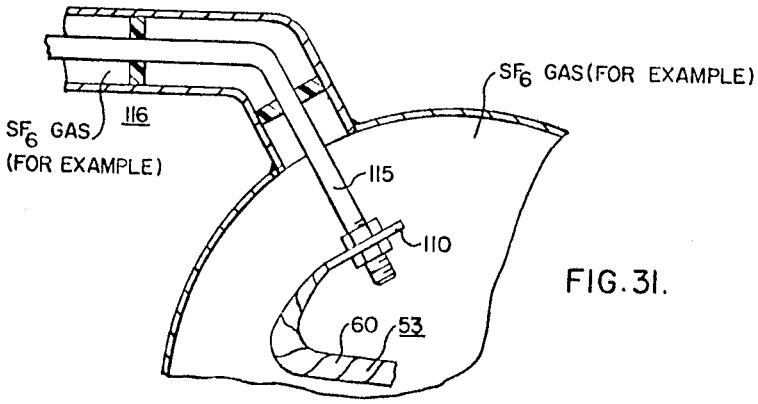

During the opening operation, the valve mechanism 80 is actuated to effect, through the piston 81 and the aforesaid interconnecting linkage, the downward opening movement of both movable contact structures 15 to the position illustrated in FIG. 3.

Where the terminal-bushings 58 and 59 are not utilized for certain applications, the construction, as illustrated in FIG. 31, may be employed, wherein the terminal straps 110, 111, affixed to the flexible connectors 60, 61, may be fixedly secured to conductors 115, which constitute a part of a gas-insulated transmission system 116. A fragmentary portion of such a gas-insulated system 116 is illustrated in FIG. 31.

Figures 4, 13, 14:
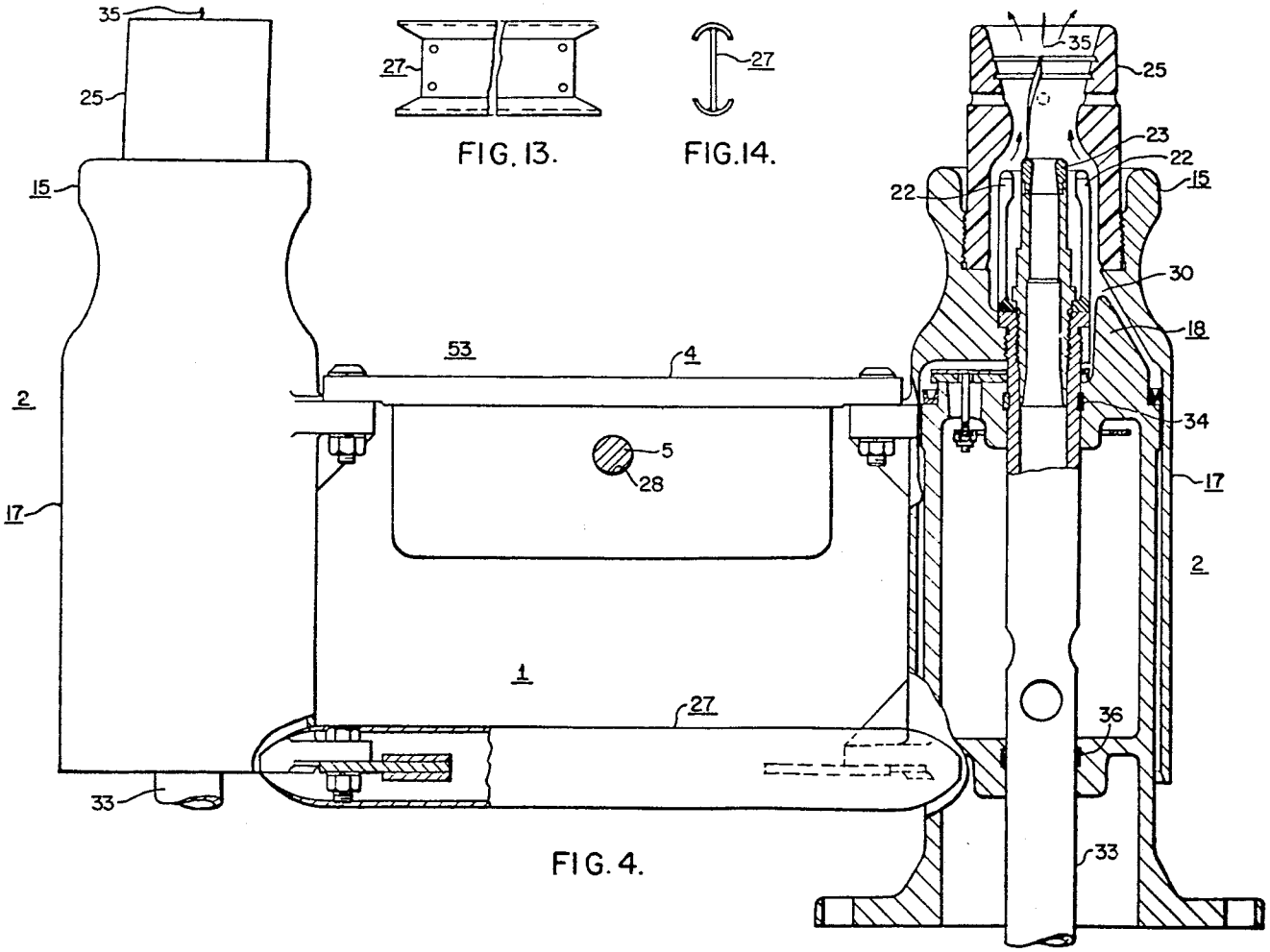
FIG. 4 is a considerably-enlarged, side-elevational view of the two modular units arranged in electrical series, the left-hand modular unit being shown in side elevation, whereas the right-hand modular, puffer-type, interrupting unit is shown in vertical section, the contact structure being illustrated in the fully-open-circuit position.
FIG. 13 is a top plan view of the lower-disposed supporting shielding structure for rigidly supporting the two operating cylinders and for causing their simultaneous movement.
FIG. 14 is an end elevational view of the lower-disposed shielding cross-bar structure of FIG. 13.
Figure 15:
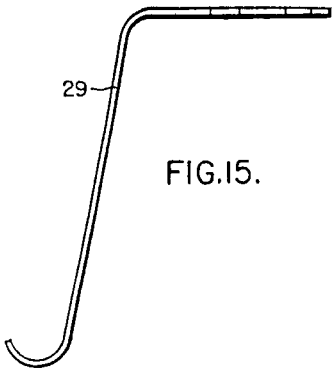
FIG. 15 is a side elevational view of a spring-clip member fastened to the relatively-heavy metallic support casting, which supports the two puffer units and is adapted to hold into accurate position the two tubular shielding ring members of FIGS. 24 and 27.
Figure 16:
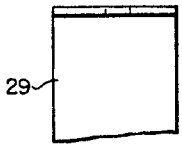
FIG. 16 is a fragmentary end elevational view of the spring-clip assembly of FIG. 15.
Figure 17:
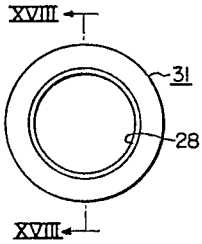
FIG. 17 is a side elevational view of a spherical bearing used for connecting the operating rod to the conducting cross-bar structure.
Figure 18:
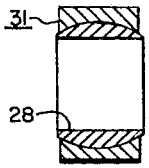
FIG. 18 is a vertical sectional view taken substantially along the line XVIII-XVIII of FIG. 17.

FIG. 4 more clearly illustrates the electrical and mechanical interconnection between the two modular puffer units 2, including an upper generally U-shaped shielding cross-bar structure 4 and a lower-disposed similar U-shaped shielding structure 27. The upper shielding structure 4 has a pair of lateral bearing holes 28 provided therein accommodating a horizontally-disposed pivot-pin 5, which accommodates a spherical bearing 31 more clearly illustrated in FIGS. 17, 18 and 19 of the drawings. By so using a spherical bearing 31, compensation is provided for inaccuracies of manufacture of the several parts.

Figure 19:
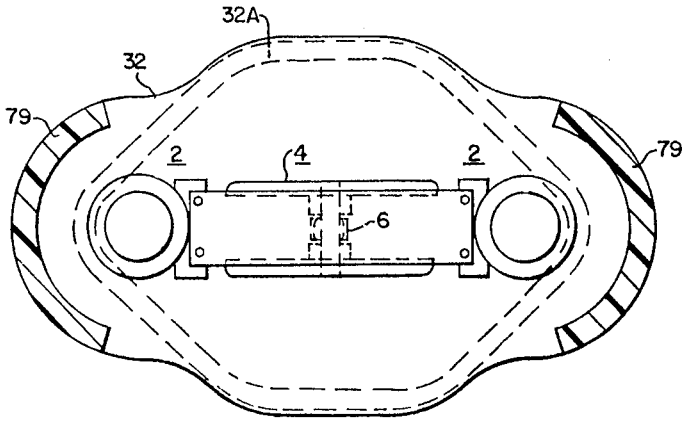
FIG. 19 is a horizontal sectional view taken substantially along the line XIX-XIX of FIG. 3 with certain parts omitted for clarity.
Figure 20:
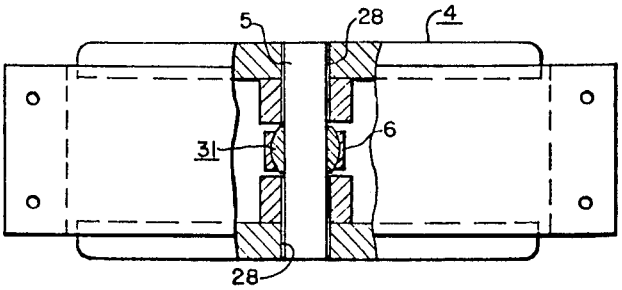
FIG. 20 is a top plan view, partly in cut-away section, of the upper-disposed conducting shielding cross-bar structure, illustrating the spherical bearing-pivot connection for the operating rod.
Figure 30:
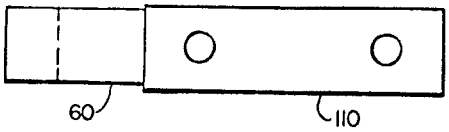
FIG. 30 is a top plan view of the resilient conductor strap associated with the left-hand stationary contact assembly of FIG. 1, indicating its manner of connection to the lower ends of the terminal-studs of the terminal-bushings; and, FIG. 31 illustrates an alternate modified-type of electrical line connection for the improved interrupting structure of the present invention, wherein the terminal-bushings 58, 59 of FIG. 1 are omitted, and in their place, electrical connection is alternatively connected to a "pipes" type of gas-insulated transmission-line system.
Figure 29:
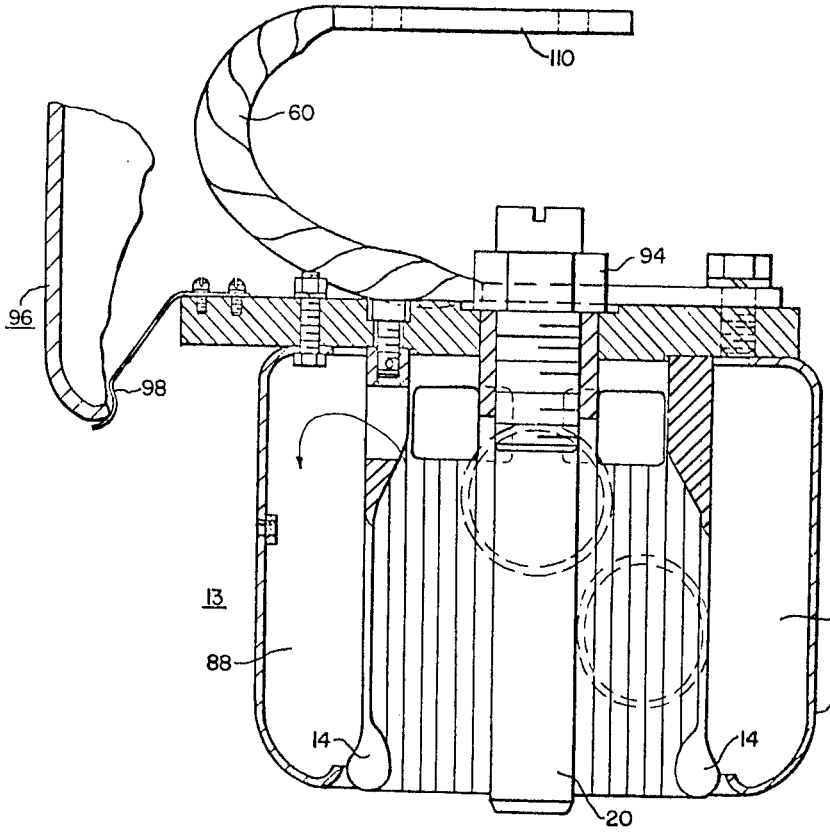
FIG. 29 is a considerably-enlarged vertical sectional view taken through the left-hand stationary contact assembly of FIG. 1, illustrating the resilient supporting arrangement for the upper-disposed cylindrical shield member 96 for removably supporting the same.

As illustrated in FIG. 4, each of the movable operating cylinders 17 is guided by a steel rod 33, for example, slidable within guides 34 and 36 provided in the stationary puffer pistons 18, and serving to guide the movable operating cylinders 17 as they move to the open or closed circuit positions of the circuit-interrupter 53. The stationary pistons 18 are mounted upon a central mounting plate 32, on which are also mounted electrostatic shielding ring-shields 73, 74, 76 and 78 for relieving the critical voltage regions and half-circle shaped support insulators 79, which support the upper terminals 66, 67, shields 96, 97 and arcing contacts 20 of the interrupter 53. FIG. 19 illustrates a horizontal sectional view taken through the side semi-circular, upstanding, insulating support members 79.

The main current passing through the circuit-interrupter 53 is transferred by means of cupaloy finger clusters 14, for example, which mount upon the upper stationary contact terminal 13, and transfers current to the annular outside main movable contact 15 of each movable puffer, or operating cylinder 17. Secondary contacts 22 are provided inside of each moving operating cylinder 17 to handle the arc 35 during circuit-interruption, as set forth in the foregoing patent applications.

Two electrostatic shields 96, 97 mount upon the top stationary contact terminals 13. The lower shield 97 acts as a voltage shield and also deflects much of the hot, ionized gas, created during interruption, into regions 88 in the breaker 53 having relatively low-voltage stress and a large gas volume to mix with the hot gas 16. The upper shield 96 hides the top terminal bolts 94 and the shunts 60, 61, which are connected, in the final assembly to the breaker entrance bushings 58, 59. Special spring clips 98 (FIGS. 9, 10) hold the shield 96 in place, and allow easy and fast removal of the shield 96 to access for the shunts 60, 61 and bolting hardware 94. Capacitors 37 are provided across the interrupter assembly 1 to aid in current interruption. The top terminal 13 and shield arrangement 96, 97 is independent of the type of bushing 58, 59 which is used on the complete circuit-breaker 53. The breaker 53 may thus be used in free-standing, or gas-insulated substation applications, as shown in FIG. 31.

The improved circuit-interrupter 53 of the present application is particularly capable of operating on a 242 Kv transmission-line, and, moreover, is capable of continuously passing currents of the order of 3,000 to 4,000 amperes, for example. The interrupting capacity may be of the order of 50,000 amperes, for example.

In mounting the capacitor tubes 37, it will be observed that each capacitor-tube 37 has a lower stud-portion 38 (FIG. 21), which fits into a recess 39 (FIG. 11) provided in the metal central cast support-plate 32, with a spring-clip 42 to make good contact therebetween. The upper end of the capacitor-tube 37 is mounted to the side of the lower electrostatic shield 97, as illustrated in FIG. 3.

The upper electrostatic shield 96 is readily mounted and disassembled by the utilization of three equally-spaced spring-clips 98, more clearly illustrated in FIGS. 9, 10. When the modular circuit-interrupting structure 53 is desired to be utilized in a circuit-interrupter of the type of FIG. 1, it will be observed that no tensile or compressive stresses are imposed upon the lower ends of the terminal-bushings 58, 59, but merely a flexible connector 60 or 61 is provided therebetween. The sole support for the stationary contact structure 13 is thereby provided by the upstanding supporting insulating cylindrical supports 79.

The central mounting plate 32 is a cast aluminum member, for example, shaped to provide high mechanical strength and support for the piston pressure loading during breaker operation and to provide electrical shielding of the electrically poorly-shaped guide rods 33 and main insulating tube mounting bolts. In a general viewpoint, the more smooth, continuous or round a shape is, the higher an electrical stress it can sustain or be allowed to be near. The oval ribbing 32A on the mounting plate 32 is the main shielding for the above-mentioned poor shapes.

The side vertical support-plates 79 are very important, inasmuch as they must have the requisite strength for supporting the upper-disposed relatively-stationary contact assemblies 13. Additionally, these vertical side-support plates 79 have an additional function of keeping the arc and hot arcing products away from the side-walls 48 of the outer grounded metallic tank 41. Of the utmost importance, however, is the fact that the side-insulating support-plates 79 support the upper stationary contact structures 13, so that the upper terminal members are completely supported independently from the terminal-bushings 58, 59, when the latter are used. As a result, the stationary contact structures 13 may merely be electrically connected by a flexible conductor 60, 61 to the lower, interior ends of the terminal-studs 66, 67 of the terminal-bushings 58, 59 when they are used; and when they are not used, electrical connection may, alternatively, be made to the interior live "hot" conductors 115 of "pipes" utilized in "pipe-type", gas-insulated transmission-line equipment 116 (FIG. 31).

By utilizing the side-support plates 79 there is no necessity for having any supporting cross-member (not shown) between the two laterally-spaced stationary contact structures 13. This has the advantage that there are no surface creepages, which would be encountered, and advantage is taken of the high insulating qualities of the sulfur-hexafluoride ($SF_6$) gas 16 disposed within the outer tank structure 41.

An additional advantageous result of the foregoing arrangement is that it allows the interrupter assembly 1, which is completely supported from the lower, relatively-heavy cast base 12, to be built-up as a bench unit-assembly 1, that can be actually completely tested, adjusted and subsequently put into a surrounding circuit-breaker tank 41.

The insultating half-shields 79 are fabricated of a glass-wound epoxy material, for example, having embedded mounting studs therein at the upper and lower ends. The gas flow is, consequently, directed into regions within the circuit-breaker tank 41, where it encounters relatively cool un-ionized gas.

The upper metallic electrostatic shield 96 is the main shield to hide all of the top bolts 94 and shunts of the stationary contact assembly 13, and relieve the voltage gradient around the sharp corners of the hardware items 94, which must be hidden from the voltage field. Accordingly, the present invention provides an easy assembly and disassembly feature, whereby the upper metallic electrostatic shield 96 may be secured, as by a metallic clipping arrangement, by the use of three evenly-spaced resilient metallic mounting clips 98, for example, so as to removably hold the upper metallic electrostatic shield 96 in place.

We have used, for example, three evenly-spaced resilient clips 98, which are just a bent-up piece of spring steel, which results in a resilient holding of the metallic shield 96. In other words, all one must do is to take hold of the upper-disposed electrostatic shield 96, push it down over these three resilient metal clips 98, and the clips 98 are distorted somewhat, and then one hears an audible click, and the electrostatic shield 96 is thus pushed into a region, where it is mechanically trapped by these three spaced resilient clips 98. They are preferably evenly spaced around a circle, so that when one pushes the electrostatic shield 96 on, and it clicks into the end configuration of the three clips 98, one cannot move it either up or down.

To remove the metallic electrostatic shield 96 requires no special tools. One merely reaches in and puts one's thumb under one of the resilient clips 98, pulls it back, and the upper-disposed electrostatic shield 96 will come up. One can accordingly get it off and removed with just two hands and no required tools.

With regard to the shunting capacitors 37, the mounting technique appears to be rather unique, in that the capacitor-tube 37 has end fittings 62, 63 on each end, which are required because it is not mechanically strong enough by itself to be directly mounted to anything. The lower end-fitting 63 is simply a stud 38 sticking out of the lower end of the capacitor-tube 37, resembling a straight pin; and there is a drilled hole 39 in the central, relatively-heavy mounting plate 32. One just drops this stud 38, at the end of the capacitor-tube 37, into the provided recess 39, and there is no bolting at the lower end of the capacitor-tube 37 whatsoever. Also, at the bottom end of the capacitor-tube 37 there is a little spring clip 43 (FIG. 22), which makes an electrical connection to the support plate 32. It resembles a little contact, such that when the stud 38 is dropped out into the hole 39, this contact 43 makes up, so that one automatically makes electrical contact with the central, relatively-heavy mounting casting plate 32 and the bottom of the capacitor-tube 37. Then all one needs to do is swing the capacitor-tube 37 over a few degrees, and an assembly man inserts one mounting bolt 50 (FIG. 23) at the top connection of the capacitor-tube 37, and it bolts into the lower metallic electrostatic shield 97 of the upper stationary contact assembly 13 by an accommodating mounting hole. This results in a relatively-easy method of attachment.

The interrupting assembly 1 provides a unit, which is completely made up of modular pieces, roughly three in number, that make up the entire interrupter 53, and allowing for adjustments and inspection to be done on a bench-assembly basis, that is in an environment where it is very easy to work in.

The modules 2 can then be assembled into the breaker through the man-way 70 of the breaker tank 41, or assembled onto the lower base-plate 12, onto which the component parts mount; and subsequently the entire package 1 may be inserted up into the breaker tank 41.

This design permits several men to be inside of the breaker tank 41 at one time for any allows or inspection purposes, and additionally allow for a very quick changeout of any parts, which may be degraded or deteriorated during the operational life of the circuit-breaker 53. All parts, which are possibly subject to wear, can be immediately replaced without difficulty. This can be done easily through the man-way 70 (FIG. 1). Inspection of parts, additionally, may be made through the man-way 70. There is nothing to block the vision of this inspection and maintenance is facilitated.

For adapting the modular-type circuit-interrupting structure 53 for gas-insulated transmission-line equipment 116, reference may be made to FIG. 31 for illustrating the alternate construction, involving merely a "hot" line connector 115, which may be, as before, connected by a flexible lead 60 to the relatively-stationary contact structure 13.

A most important feature of the tank design 41 is its adaptability to gas-insulated breaker arrangements 116. This is because of the compact geometry and versatile entrance flanges 55, 56 (FIG. 2).

The hollow insulating support tube 40 is constructed of cast epoxy with suitably shaped metallic inserts used for attaching the tube to the lower support 12 and the central support plate 32. Use of the cast epoxy allows a very compact overall breaker design because a relatively high electrical stress can be allowed in this material. This allows a very short length tube to be used, reducing the diameter of the tube because a shorter tube will have less mechanical moment (from shipping and operating loads) impressed upon it. This then allows the central support plate 32 to be relatively smaller and the tank 48 to be shorter and of a smaller diameter than it would be if some other material was used for the hollow support tube 40.

Although there have been illustrated and described specific structures, it is to be clearly understood that the same were merely for the purpose of illustration, and that changes and modifications may readily be made therein by those skilled in the art, without departing from the spirit and scope of the invention.

We claim:

1. A compressed-gas, puffer-type, circuit-interrupting assemblage comprising a pair of laterally-disposed modular-type puffer interrupting units, each puffer interrupting unit comprising a relatively-stationary contact structure and a separable movable contact structure, means defining a side-insulating baffle-plate for each puffer-type interrupting unit for fixedly supporting the stationary and movable contact structures in a predetermined vertically, spaced-apart relationship, means defining a relatively-heavy lower metallic supporting plate, means securing each of said side insulating baffle-plates to said relatively-stationary lower-disposed metallic supporting plate, a relatively-stationary piston structure for each puffer unit, each respective relatively-stationary piston structure being upstandingly supported by said lower-disposed relatively-heavy metallic supporting plate, each puffer interrupting unit including, additionally, a movable operating cylinder carrying said movable contact structure and sliding over said relatively-stationary piston structure for compression of gas therebetween, line-terminal connection means, means for electrically connecting the relatively-stationary contact structure to said line-terminal connecting means for each puffer-type interrupting unit, a generally horizontially-extending cross-bar structure mechanically and electrically connecting the two movable operating cylinders, a vertically-movable insulating operating rod pivotally connected by a spherical bearing to said horizontally-extending cross-bar structure, whereby compensation is obtained for manufacturing inaccuracies and for providing proper alignment of vertical motion of the two laterally-spaced operating cylinders.

2. The combination according to claim 1, wherein each puffer-type interrupting unit has a vertical metallic guide-stem rod associated with its respective movable contact structure, and each respective metallic guide-stem rod being guided by said relatively-stationary piston structure.

3. The combination according to claim 2, wherein the lower-disposed relatively-heavy metallic supporting plate has a downwardly-extending flange or rib portion to electrostatically shield the guide-stem rod in its fully-open-circuit position.

4. Circuit-interrupting electrical equipment including separable contact means (13, 15) to establish an arc, said separable contact means including a relatively-stationary contact (13) and a cooperable movable contact (15), line-terminal connecting means associated with said relatively-stationary contact, a first, generally-cylindrically-shaped metallic electrostatic shield (97) encompassing the relatively-stationary contact (14) and ensuring a low-gradient electrostatic field between the separated contacts (13, 15) in the fully open-circuit position of the circuit-interrupter, and a second, generally-cylindrically-shaped metallic electrostatic shield (96) located upwardly of the first-mentioned shield (97) for encompassing the line-terminal connecting means of said stationary contact means (13).

5. The combination according to claim 4, wherein a plurality of resilient metallic clips (98) are provided to enable a ready assembly and disassembly of the said upper-disposed metallic electrostatic shield (96).

6. The combination according to claim 5, wherein three evenly-spaced resilient clips (98) are provided to secure the ready assembly and disassembly of said upper-disposed metallic electrostatic shield (96).

7. The combination according to claim 1, wherein each puffer-type interrupting unit has its respective capacitor-tube, and the respective capacitior-tube is provided with a lower-disposed mounting stud, which may readily be placed in a recess portion provided in the generally horizontally-disposed relatively-heavy metallic supporting plate.

8. The combination according to claim 7, wherein the upper end of the capacitor-tube may be detachably bolted to the upper stationary contact structure of the circuit-interrupter.

9. The combination according to claim 1, wherein a vertically-disposed hollow insulating support tube is provided surrounding the vertically-arranged operating rod and additionally supporting said relatively-heavy metallic supporting plate upwardly away from grounded, lower-disposed housing structure.

10. The support tube of claim 9 as a cast epoxy tube with suitably shaped metallic inserts cast in each end to serve as mounting points.

11. The combination according to claim 1, wherein a plurality of generally U-shaped tubular metallic members are positioned around said relatively-heavy metallic supporting plate for grading the electrostatic field between the relatively-heavy metallic supporting plate and the lower-disposed grounded housing structure.

12. The combination according to claim 1, wherein the horizontally-disposed cross-bar structure is formed as a metallic electrostatic shielding structure having a generally U-shaped configuration.

13. The combination according to claim 12, wherein an additional lower-disposed metallic electrostatic shield supporting structure is fixedly secured to the lower ends of the operating cylinders.

14. The combination according to claim 2, wherein the metallic guide-stem rods have two vertically-spaced guide-supports associated with the relatively-stationary piston structure.

15. The combination according to claim 4, wherein a cluster of relatively-stationary flexible main contact fingers (14) are disposed interiorly of the first-mentioned, electrostatic shield (97), and the movable contact structure (15) comprises a movable operating puffer-cylinder (17) having an annular movable main contacting portion (15), which makes contacting engagement in the closed-circuit position with said cluster of relatively-stationary contact fingers (14).

16. A puffer-type compressed-gas circuit-interrupter including, in combination, means defining an upstanding metallic grounded tank structure, a pair of laterally-spaced terminal-bushings extending downwardly interiorly within said grounded metallic tank structure each carrying a line-conductor thereinto, a pair of laterally-spaced puffer-type compressed-gas circuit-interrupting units each including a relatively-stationary piston structure and a movable operating cylinder slidable thereover and carrying a movable contact structure therewith, means defining a relatively-stationary contact structure cooperable with said movable contact structure and electrically connected to a respective line-conductor carried by a respective terminal-bushing, common operating means including a conducting cross-bar mechanically interconnected to the two operating cylinders and a vertically-extending insulating operating-rod structure, whereby vertical opening and closing movements of said operating-rod structure cause simultaneous opening and closing movements of the movable operating cylinders and, additionally, opening and closing movements of the two movable contact structures, a generally-cylindrical hollow insulating supporting member surrounding said vertically-extending operating rod and supporting at its upper end a generally-horizontally-extending relatively-heavy metallic support-plate structure, each of the two stationary piston structures being upstandingly fixedly supported by said relatively-heavy metallic supporting plate structure, said hollow cylindrical insulating support member resting upon the lower portion of the grounded metallic tank structure, whereby the weight of the two puffer interrupting units is substantially carried wholly by said lower portion of the grounded metallic tank structure.

17. The combination according to claim 16, wherein an operating mechanism is located externally of the grounded metallic tank structure, and linkage means mechanically interconnects said operating mechanism with said vertically-extending operating-rod structure.

18. The combination according to claim 17, wherein a bell-crank pivotal linkage structure is disposed below said upstanding hollow cylindrical insulating support member said interrelates vertical opening and closing movements of said operating rod with said externally-located operating mechanism.

19. The combination according to claim 16, wherein the upstanding hollow insulating supporting cylindrical member is fabricated from a glass-wound epoxy material.

20. A high-voltage compressed-gas puffer-type, circuit-interrupting assemblage comprising a pair of laterally-disposed modular-type puffer interrupting units, each puffer interrupting unit comprising a relatively-stationary contact structure and a separable movable contact structure, means defining a side-insulating baffle-plate (79) for each puffer-type interrupting unit for fixedly supporting the stationary and movable contact structures in a predetermined, spaced-apart relationship, a relatively-stationary piston structure for each puffer unit, each respective relatively-stationary piston structure being fixedly supported adjacent its lower end, each puffer interrupting unit including a movable operating cylinder carrying said movable contact structure and sliding over said relatively-stationary piston structure for the compression of gas therebetween, line-terminal connection means, means for electrically connecting the relatively-stationary contact structure to said line-terminal connecting means for each puffer-type interrupting unit, a generally-bridging movable cross-bar structure for mechanically interconnecting the two movable operating cylinders for simultaneous movement thereof, and a movable insulating operating rod connected to said movable bridging cross-bar structure.

21. The combination according to claim 20, wherein each puffer-type interrupting unit has a vertical metallic side-stem rod associated with its respective movable contact structure, and each respective metallic guide-stem rod being guided by said relatively-stationary piston structure.

22. The combination according to claim 21, wherein a lower-disposed relatively-heavy metallic supporting plate is provided having a downwardly-extending flange or rib portion to electrostatically shield the guide-stem rod in its fully-open-circuit position.

* * * * *